US007322800B2

(12) United States Patent
Roth

(10) Patent No.: US 7,322,800 B2
(45) **Date of Patent: *Jan. 29, 2008**

(54) SYSTEM AND METHOD OF PROVIDING HYDRAULIC PRESSURE FOR MECHANICAL WORK FROM AN ENGINE LUBRICATING SYSTEM

(75) Inventor: David B Roth, Groton, NY (US)

(73) Assignee: BorgWarner Inc., Auburn Hills, MI (US)

( * ) Notice: Subject to any disclaimer, the term of this patent is extended or adjusted under 35 U.S.C. 154(b) by 278 days.

This patent is subject to a terminal disclaimer.

(21) Appl. No.: 11/091,567

(22) Filed: Mar. 28, 2005

(65) Prior Publication Data

US 2005/0232787 A1 Oct. 20, 2005

Related U.S. Application Data

(63) Continuation-in-part of application No. 10/826,104, filed on Apr. 16, 2004, now Pat. No. 6,889,634.

(51) Int. Cl.
*F04B 17/00* (2006.01)
*F04B 35/00* (2006.01)

(52) U.S. Cl. ..... 417/364; 417/437; 417/540; 62/323.1; 123/41.44; 123/41.65; 123/90.12; 123/196 R; 123/565; 180/442; 290/1 R

(58) Field of Classification Search ..... 62/323.1; 123/41.44, 41.65, 90.12, 196 R, 565; 180/442; 290/1 R; 417/364, 437, 540
See application file for complete search history.

(56) References Cited

U.S. PATENT DOCUMENTS 3,952,509 A 4/1976 Coleman ..... 60/422
4,000,756 A 1/1977 Ule et al. ..... 137/596.17
4,383,502 A 5/1983 Skatsche et al. ..... 123/41.44
4,420,937 A 12/1983 Naruse et al. ..... 60/450

(Continued)

FOREIGN PATENT DOCUMENTS

EP 1048862 11/2000

(Continued)

OTHER PUBLICATIONS

Integrated Hybrid Hydraulic Vehicle Simulation; 1 page; http;//me.engin.umich.edu/autolab/Projects/HHV.html.

(Continued)

*Primary Examiner*—Anthony D. Stashick
*Assistant Examiner*—Leonard J Weinstein
(74) *Attorney, Agent, or Firm*—Brown & Michaels, PC

(57) ABSTRACT

The method provides hydraulic pressure for mechanical work from an engine lubricating system in an internal combustion engine by supplying oil to an engine lubrication gallery for lubricating the engine and to at least one variable oil demand accessory. Each of the variable oil demand accessories has an individual pressure regulator. The output of the variable displacement pump is regulated based on the sum of fluid flow required by the engine lubricating system and the engine accessories, regardless of the engine output. The demand for fluid is determined by the individual pressure regulators on each of the engine accessories. In a preferred embodiment, an accumulator stores high-pressure fluid to be used to power the hydraulic accessories.

26 Claims, 6 Drawing Sheets

U.S. PATENT DOCUMENTS

| | | | | |
|---|---|---|---|---|
| 4,501,536 | A | 2/1985 | Middlekauff | 418/61 B |
| 4,586,885 | A | 5/1986 | Middlekauff | 418/61 B |
| 4,596,517 | A | 6/1986 | Laguionie | 417/216 |
| 4,819,430 | A * | 4/1989 | Becker | 60/421 |
| 4,936,402 | A | 6/1990 | White, Jr. | 180/132 |
| 5,511,522 | A * | 4/1996 | Tran | 123/196 S |
| 5,800,131 | A | 9/1998 | Lehmann et al. | 417/270 |
| 6,460,500 | B1 * | 10/2002 | Ooyama et al. | 123/179.3 |
| 6,579,070 | B1 | 6/2003 | Birkenmaier et al. | 417/216 |
| 6,622,672 | B1 | 9/2003 | Styron et al. | 123/78 |
| 6,644,025 | B1 | 11/2003 | Oberhausser et al. | 60/422 |
| 6,889,634 | B1 * | 5/2005 | Roth | 123/41.44 |

FOREIGN PATENT DOCUMENTS

| | | |
|---|---|---|
| EP | 1362994 | 11/2003 |
| JP | 02175336 | 7/1990 |

OTHER PUBLICATIONS

FuturePundit; 4 pages; http://www./futurepundit.com/archives/001003.html.

Pi Technology; 1 page; http://www.pitechnology.com/services-vehicles. php?id=2.

The New Hybrid Cars; 6 pages; http://eartheasy.com/live_hyprid_cars.htm.

ARTSA; Monash University; slide 6-8, 13; http//www.artsa.com.au/ARTSA_Matheson_TMC_Nov03.pdf.

* cited by examiner

SYSTEM AND METHOD OF PROVIDING HYDRAULIC PRESSURE FOR MECHANICAL WORK FROM AN ENGINE LUBRICATING SYSTEM

REFERENCE TO RELATED APPLICATIONS

This is a continuation-in-part patent application of application Ser. No. 10/826,104, filed Apr. 16, 2004 now U.S. Pat. No. 6,889,634, entitled "METHOD OF PROVIDING HYDRAULIC PRESSURE FOR MECHANICAL WORK FROM AN ENGINE LUBRICATING SYSTEM". The aforementioned application is hereby incorporated herein by reference.

BACKGROUND OF THE INVENTION

1. Field of the Invention

The invention pertains to the field of engine lubricating systems. More particularly, the invention pertains to a method of providing hydraulic pressure for mechanical work from an engine lubricating system.

2. Description of Related Art

Conventionally, accessories in cars (e.g. cooling fan, power steering system, A/C compressor, engine coolant pump, supercharger, and alternator) are powered using separate engine driven, fixed displacement pumps, or by direct drive, where the individual power demands of the accessories are not well matched to engine speed.

Solutions to the allocation of power by accessories are shown in U.S. Pat. No. 3,952,509, U.S. Pat. No. 4,420,937, U.S. Pat. No. 4,819,430, U.S. Pat. No. 5,800,131 and U.S. Pat. No. 6,644,025.

In U.S. Pat. No. 3,952,509 a variable displacement pump supplies hydraulic fluid to continuous and intermittent output hydraulic circuits. The continuous circuit supplies pressure for the power steering in a tractor, and the intermittent circuit provides pressure for activating hydraulic rams, for example, for moving an auger up and down. A first flow divider provides constant pressure to the continuous hydraulic circuit. A second flow divider provides pressure if any of the hydraulic cylinders in the intermittent hydraulic circuit are actuated. The loads on the system are for hydraulic pistons and not continuous flow devices, such as motors, and the system does not provide engine lubrication.

U.S. Pat. No. 4,420,937 discloses a system where the displacement of a variable displacement pump in a hydraulic circuit is at a minimum when the actuators in the system are not operating. The circuit includes a flow sensor that detects the dynamic pressure of a fluid and can covert static pressure to dynamic pressure.

U.S. Pat. No. 4,819,430 discloses a hydraulic fluid circuit that is divided into two circuits, a first circuit and a second circuit. A variable displacement pump is the fluid source for the first circuit for regulating the steering system. The second circuit is controlled by a fixed displacement pump. A valve responsive to the demands between the first circuit and the second circuit increases the amount of output from the fixed pump into the first circuit in proportion to the output of the variable displacement pump.

U.S. Pat. No. 5,800,131 discloses a variable displacement pump regulating engine lubricating oil flow based on engine parameters. Oil pressure is used to move a piston.

U.S. Pat. No. 6,644,025 discloses a control arrangement that supplies pressurized hydraulic fluid to at least two hydraulic devices. The control arrangement includes a variable displacement pump, which is controlled according to required flow and settings and pressure compensators. This control arrangement prevents excess flow of hydraulic fluid to the hydraulic devices by using the pressure compensators and allowing only one valve device to derive the control pressure from the feed pressure.

SUMMARY OF THE INVENTION

The method provides hydraulic pressure for mechanical work from an engine lubricating system in an internal combustion engine by supplying oil to an engine lubrication gallery for lubricating the engine and to at least one variable oil demand accessory. Each of the variable oil demand accessories has an individual pressure regulator. The output of the variable displacement pump is regulated based on the sum of fluid flow required by the engine lubricating system and the engine accessories, regardless of the engine output. The demand for fluid is determined by the individual pressure regulators on each of the engine accessories. In a preferred embodiment, an accumulator stores high-pressure fluid to be used to power the hydraulic accessories.

The method of providing hydraulic pressure for mechanical work from an engine lubricating system in an internal combustion engine includes the step of supplying oil from a variable displacement pump to an engine lubrication gallery for lubricating the engine. The method further includes the step of supplying oil from the variable displacement pump to at least one engine accessory having a variable oil demand, each accessory having a pressure regulator. The method further includes the step of regulating an output of the variable displacement pump to a sum of a fluid flow required by the engine lubrication system and a fluid demand generated by the pressure regulators. The method further includes the step of supplying oil from the variable displacement pump to an accumulator for storing an accumulator hydraulic pressure for later use as mechanical work.

In a preferred embodiment, the engine accessories may be a hydraulic motor driven cooling fan, a power steering system, a hydraulic motor driven air conditioning compressor, a hydraulic motor driven engine coolant pump, a hydraulic motor driven alternator, a hydraulic motor driven supercharger, an electrohydraulic valve actuation system, or a suspension actuator motor. The fluid flow for lubricating the engine is preferably based on engine parameters. In another embodiment of the invention, the method includes the step of using accumulator hydraulic pressure to power at least one of the hydraulic accessories. In yet another embodiment of the invention, the method includes the step of using the accumulator hydraulic pressure via the variable displacement pump to add work to a crankshaft driven by the engine.

The hydraulic on-demand engine accessory drive system for an internal combustion engine includes a variable displacement pump having a pump fluid communication input from a sump and a pump fluid communication output to a high-pressure manifold. The system further includes a variable displacement pump controller mounted to the variable displacement pump and in communication with an ECU. The system further includes an engine having an engine fluid communication input from the high-pressure manifold and an engine fluid communication output to the sump. The system further includes at least one engine accessory having a variable oil demand and a pressure regulator, wherein the pressure regulator is in fluid communication with and has a regulator input from the high-pressure manifold and a regulator output to the sump. The system further includes an accumulator having a fluid communication line to the high-pressure manifold for storing and supplying energy as an accumulator fluid pressure. The pump fluid communication output is regulated by the variable displacement pump controller based on a sum of flow required by the pressure regulator of the at least one engine accessory and the engine for lubrication.

The high-pressure manifold preferably powers the pressure regulator. The ECU preferably monitors sensors on the engine. The sensors preferably monitor the temperature and speed of the engine. In an embodiment of the present invention, the system further includes an oil cooler in the regulator output of the at least one engine accessory to the sump. The ECU preferably controls whether the accumulator receives oil, maintains oil, or supplies oil. The accumulator hydraulic pressure preferably powers the at least one hydraulic accessory.

In yet another embodiment of the present invention, the accumulator hydraulic pressure adds work via the variable displacement pump to a crankshaft driven by the engine. The variable displacement pump preferably replaces a conventional electric starter motor used for starting the engine.

In another embodiment, the drive system further includes a fixed displacement pump having a fixed pump fluid communication input from the sump and a fixed pump fluid communication output to the engine lubrication gallery for lubricating the engine. The variable displacement pump preferably supplies only enough oil to make up the difference between what the engine requires and what the fixed displacement pump supplies.

DETAILED DESCRIPTION OF THE INVENTION

Figure 1:
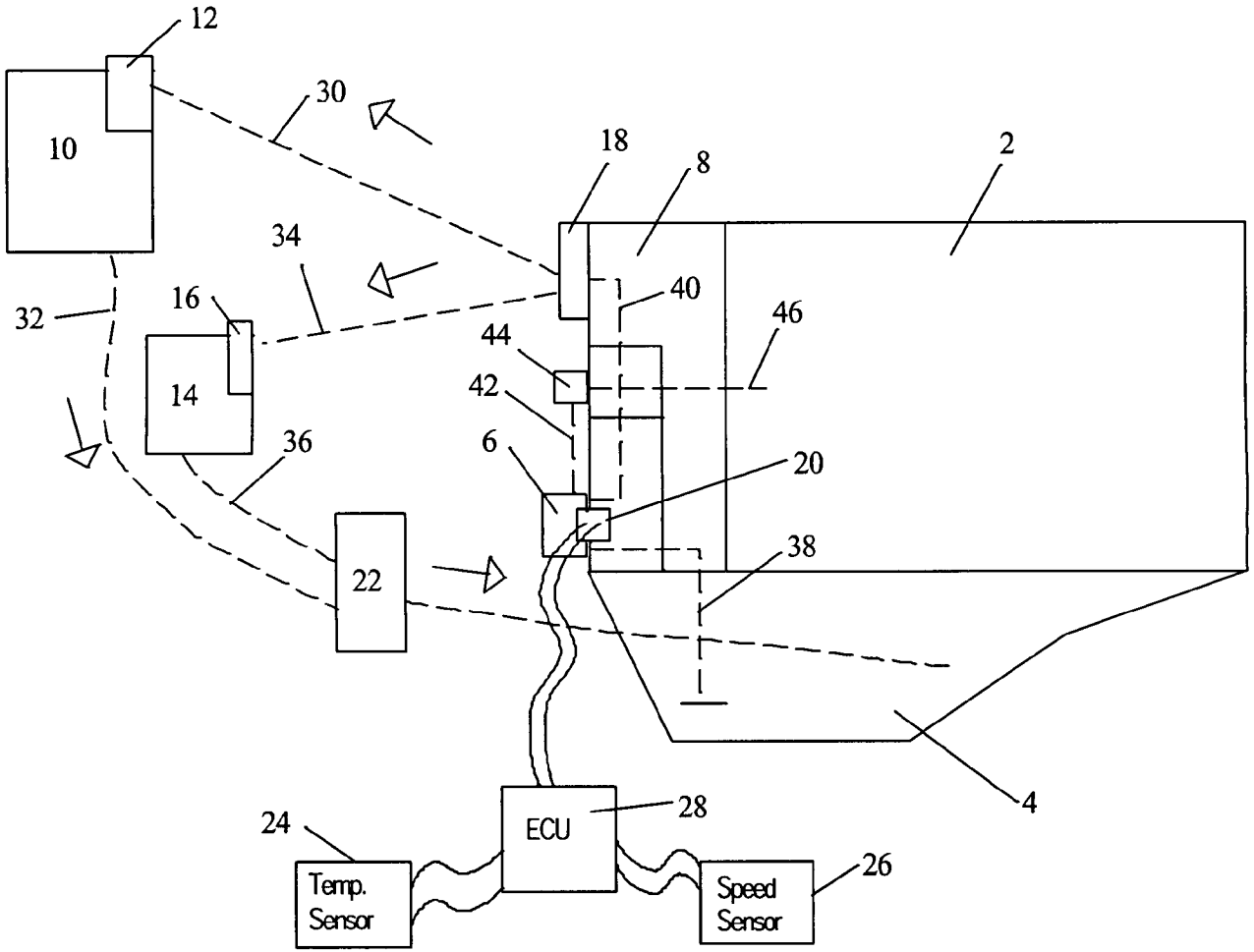
FIG. 1 shows a schematic of a system of the current invention.

Referring to FIG. 1, mounted to the front cover 8 of the engine block 2 is a variable displacement pump 6 and a variable displacement pump controller 20. Although the variable displacement pump is shown in FIG. 1 as mounted to the front cover of the engine block, it may be mounted in other places near the engine block. Below the engine block 2 is a sump or oil pan 4. Also preferably connected to the front cover 8 of the engine block 2 is a high-pressure manifold 18.

The variable displacement pump 6 is preferably driven by a conventional valve chain, gear, or belt (not shown). A fluid line 38 connects the variable displacement pump 6 to the sump 4. A second fluid line 40 passes though the front cover 8 of the engine block 2 and connects the variable displacement pump 6 to the high-pressure manifold 18. The high-pressure manifold 18 may be incorporated into the front cover or completely separate and external. The variable displacement pump 6 is regulated by the variable displacement pump controller 20 based on the sum of fluid or oil required by lubrication of the engine and the fluid demanded by the variable on-demand engine accessories 10, 14.

The engine is preferably supplied oil through passages in the front cover, similar to that of a conventional engine with a front-mounted pump. A fluid line 42 supplies engine oil from the variable displacement pump 6 to a pressure regulator 44, and another fluid line 46 supplies engine oil from the pressure regulator 44 to the lubrication galley of the engine 2. The controller 20 receives input from the engine control unit (ECU) 28, which monitors the temperature sensor 24, engine speed sensor 26, and other sensors relating to engine performance, such as a load sensor and a vehicle speed sensor.

The engine accessories 10, 14 may include, but are not limited to, a hydraulic motor-driven cooling fan, an air conditioning (A/C) compressor, an engine coolant pump, an alternator, a supercharger, an electrohydraulic valve actuation system, suspension actuators such as pumps or motors, and a power steering system. The amount of fluid each of the accessories 10, 14 needs is monitored by a separate electronic pressure regulator 12, 16, respectively. For the power steering system, the power steering fluid pressure is preferably controlled by the current state-of-the-art power steering control valve.

The return fluid from the engine accessories is supplied to the sump or oil gallery 4 via two fluid lines 32 and 36. The fluid lines 32 and 36 both preferably connect at a cooler 22 and one fluid line 42 leads to the sump 4. Alternatively, the fluid lines 32 and 36 may combine into one fluid line prior to entering the cooler 22. The pressure regulators 12, 16 of the engine accessories 10, 14 are each connected to the high-pressure manifold 18 via two fluid lines 30 and 34, respectively, and use the high-pressure manifold 18 as their power source. Although the embodiment shown in FIG. 1 includes two engine accessories, one or more than two engine accessories may be used without deviating from the spirit of the invention.

By combining the demands of the engine accessories 10, 14 with the demands of the engine lubrication and regulating the variable displacement pump 6 based on the sum of the flow required by the engine lubricating system and the amount of fluid demanded by the engine accessories 10, 14, the efficiency of all of the systems associated with the circuits are increased, since instantaneous fluid power is provided when demanded.

Figure 2:
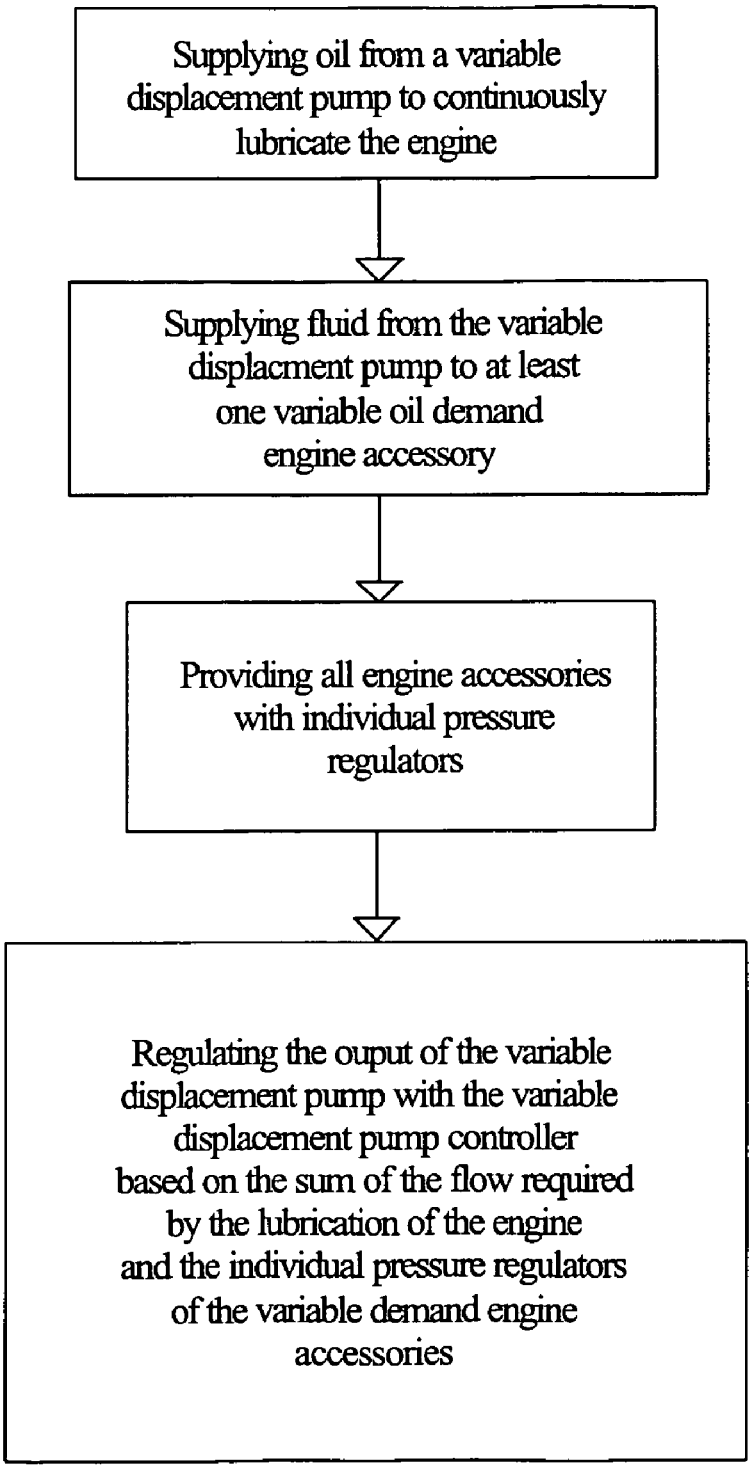
FIG. 2 shows a flow chart of the steps of the current invention.

FIG. 2 shows the steps for providing hydraulic pressure for mechanical work from an engine lubricating system by first, supplying oil or fluid from the variable displacement pump 6 to lubricate the engine in an embodiment of the present invention. The variable displacement pump 6 provides fluid or oil to at least one of the variable oil demanding engine accessories 10, 14. Each of the engine accessories is also provided with individual pressure regulators 12, 16. The variable displacement pump 6 is regulated by the variable pump controller 20, which takes into account the temperature and speed sensors monitored by the ECU 28, based on the sum of flow required by the engine lubricating system, which is continuous, though variable, and the individual pressure regulators 12, 16 of the variable on-demand engine accessories 10, 14, regardless of the engine output.

Figure 3:
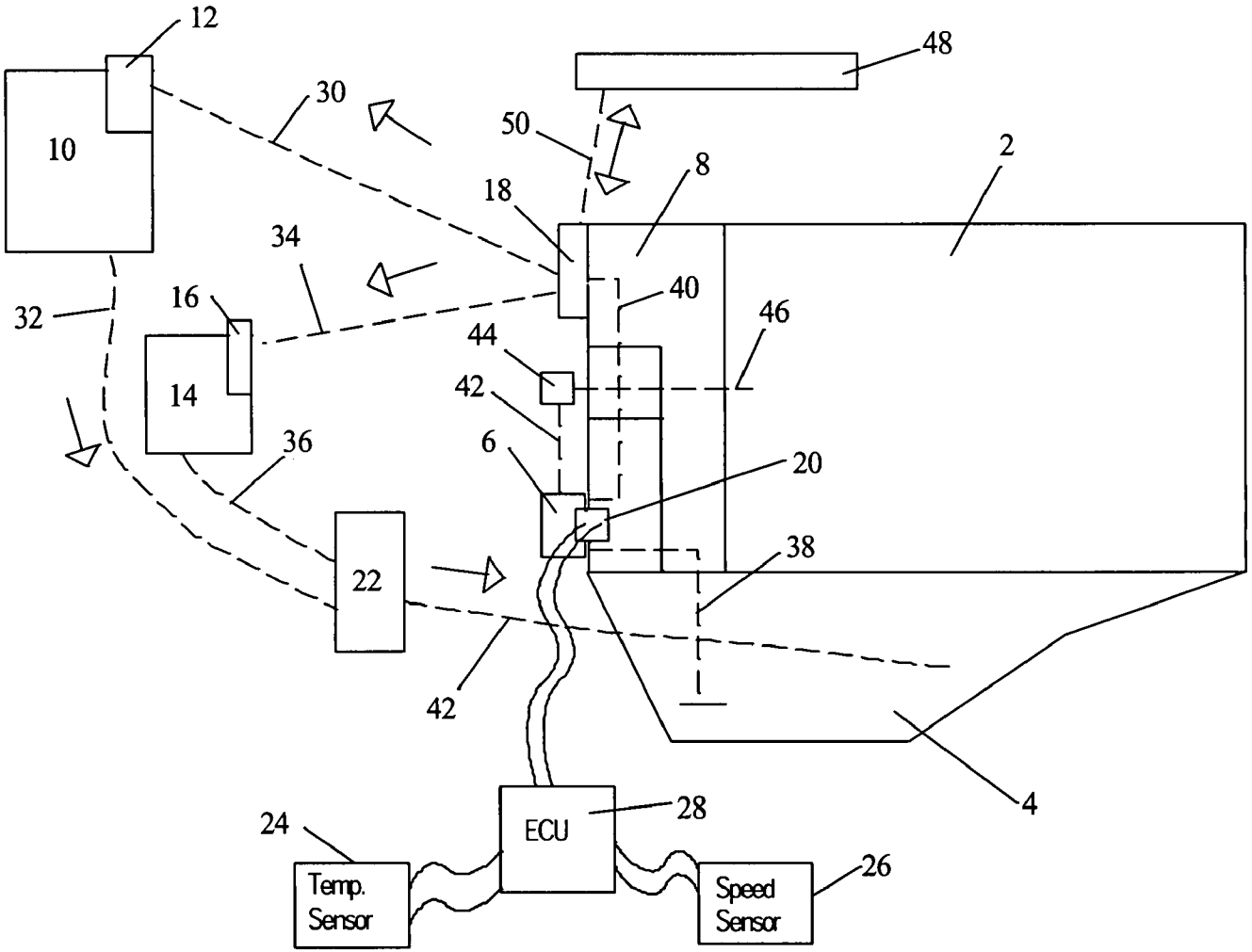
FIG. 3 shows a schematic of a system including an accumulator in an embodiment of the present invention.

Referring to FIG. 3, in another embodiment of the present invention, an accumulator 48 is attached to the high-pressure manifold 18 by a fluid line 50. Accumulator control logic is added to the ECU, and the ECU controls whether the accumulator 48 is being filled with hydraulic fluid, being held stationary, or being emptied of hydraulic fluid. For a mild hybrid embodiment, the accumulator is sized to store high-pressure fluid to be used to power the hydraulic accessories 10, 14. The accumulator 48 charges during deceleration and braking and is supplied by the variable displacement pump 6. The accumulator 48 may charge at other times, if it is depleted by extended idling or by engine start. The accumulator logic preferably attempts to maximize the charge during vehicle deceleration and attempts to empty it to approximately a 25 to 50% charge on steady-state cruise. This tends to relieve some of the overall parasitic accessory load. A sub mode of this is to model stop-start mode, where the A/C may still be powered when the vehicle is stopped at a light or in traffic.

Figure 4:
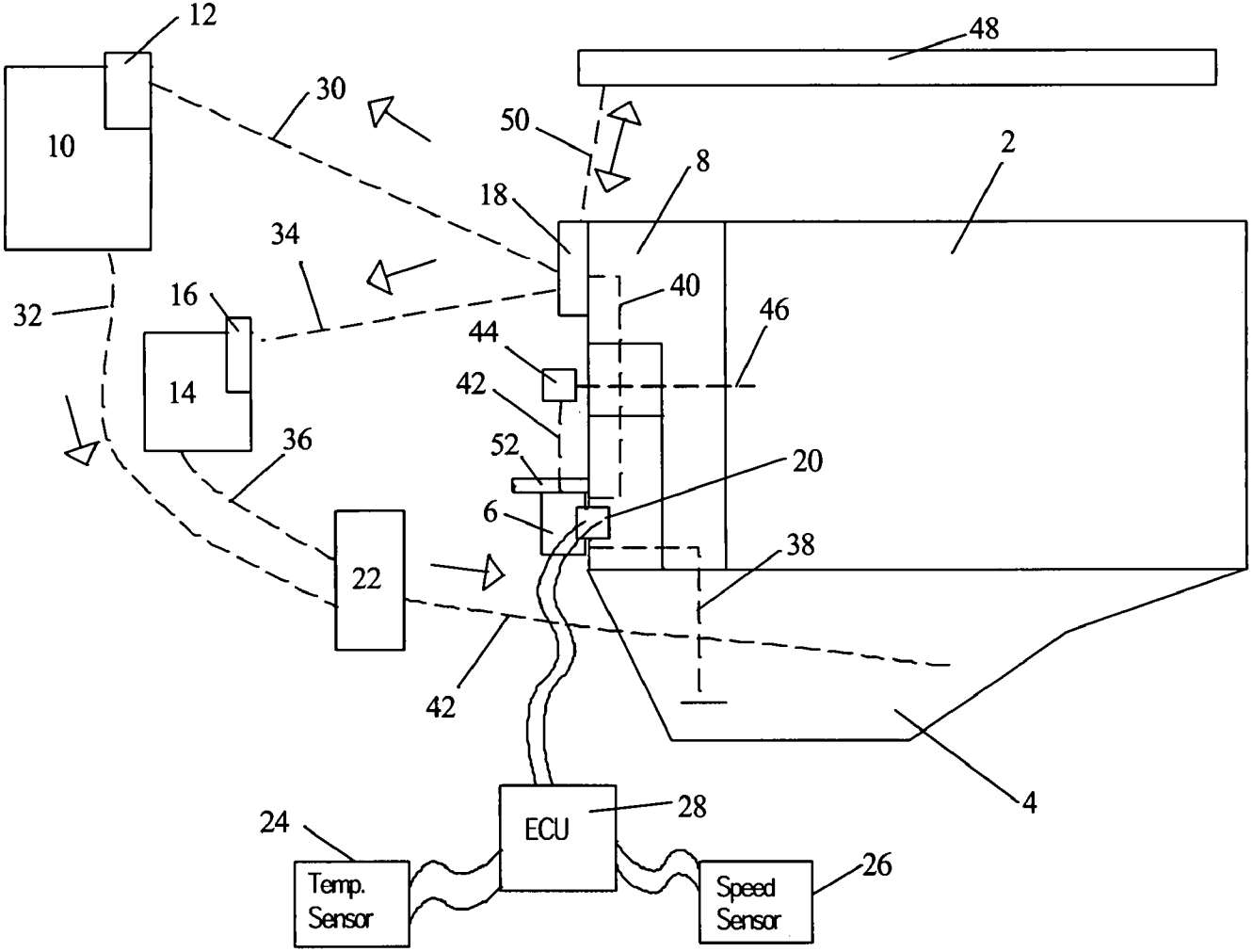
FIG. 4 shows a schematic of a system including an accumulator in another embodiment of the present invention.

Referring to FIG. 4, in yet another embodiment of the present invention, for a true hybrid embodiment, the accumulator 48 is large and the option of using the stored hydraulic energy to add work to the crankshaft 52, via a hydraulic motor, is enabled. The accumulator logic preferably attempts to maximize the charge during vehicle deceleration. The variable displacement pump 6 is preferably used as a hydraulic motor in this mode, and in fact, it optionally replaces the conventional electric starter motor. In another embodiment, the variable displacement pump 6 is used only as a pump, and a separate motor (not shown) is included with the system for adding work to the crankshaft 52. During a starting event, a portion of the supply from the accumulator 48 is used to pre-lubricate the engine, when desirable. The hydraulic assist is used to add energy to the crankshaft 52 during vehicle acceleration and also to provide fluid to the accessories 10, 14, as in the mild hybrid.

Figure 5:
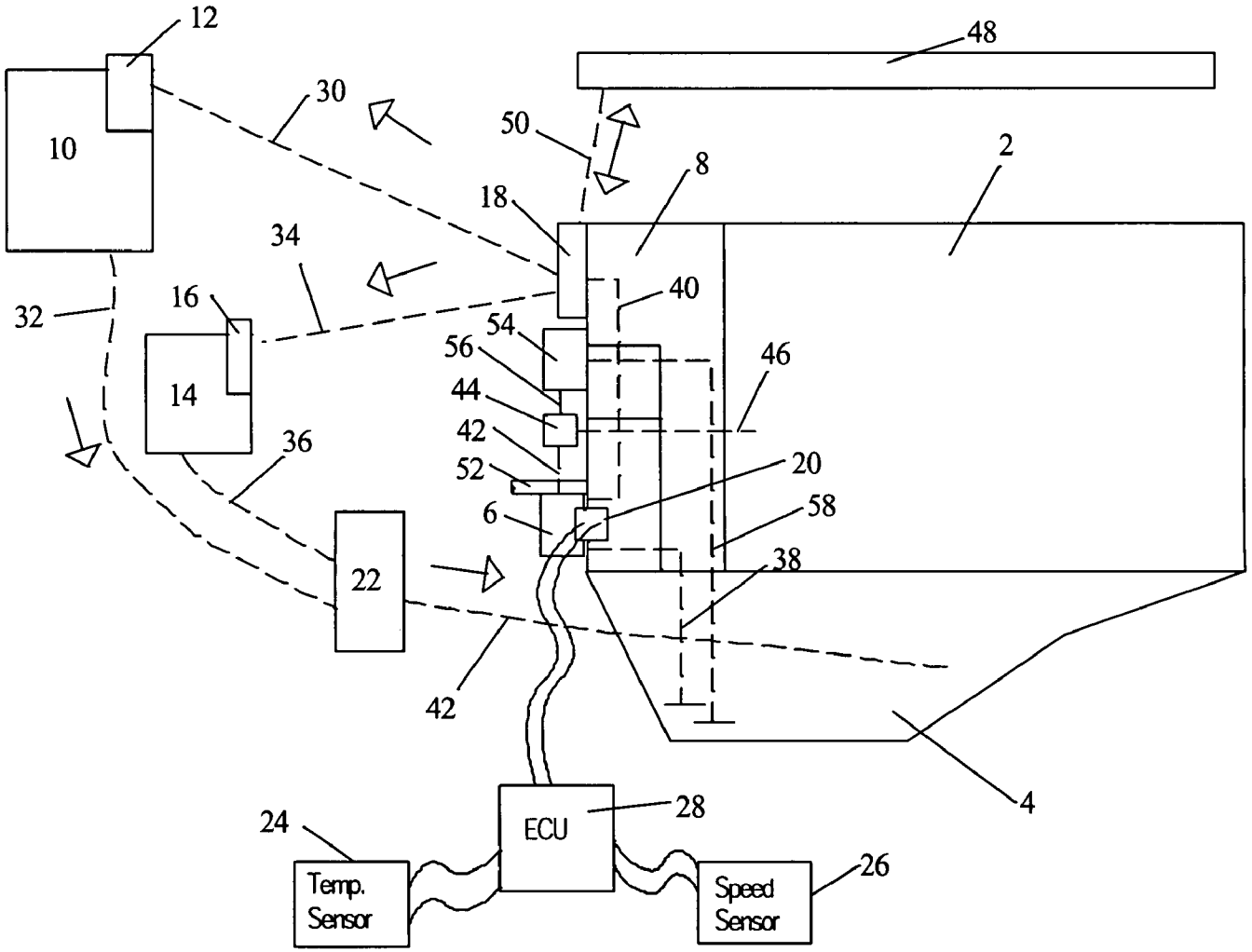
FIG. 5 shows a schematic of a system including a fixed displacement pump in yet another embodiment of the present invention.

Referring to FIG. 5, in another embodiment of the present invention, the on-demand system includes a fixed displacement oil pump 54, which is sized just barely big enough to supply the engine. A fluid line 56 connects the pump 54 to the pressure regulator 44. Another fluid line 58 connects the fixed displacement pump 54 to the sump 4. An accumulator 48 is preferably included in the on-demand system. In this embodiment, the on-demand system only supplies enough oil to make up the difference between what the engine requires and what the fixed displacement pump 54 delivers. The fixed displacement pump is preferably sized optimally based on testing or modeling for best overall efficiency. This minimizes the inefficiency of throttling all of the lubrication oil down from the high-pressure circuit. Conditions contributing to the additional demand include, but are not limited to, activation of additional engine oil demands such as variable valve timing (VVT) and variable valve actuation (VVA) devices, oil squirters, and very high engine operating conditions. The advantage of this embodiment is the possibility of higher overall efficiency, by eliminating most of the oil throttling losses, at the expense of higher pump complexity.

Figure 6:
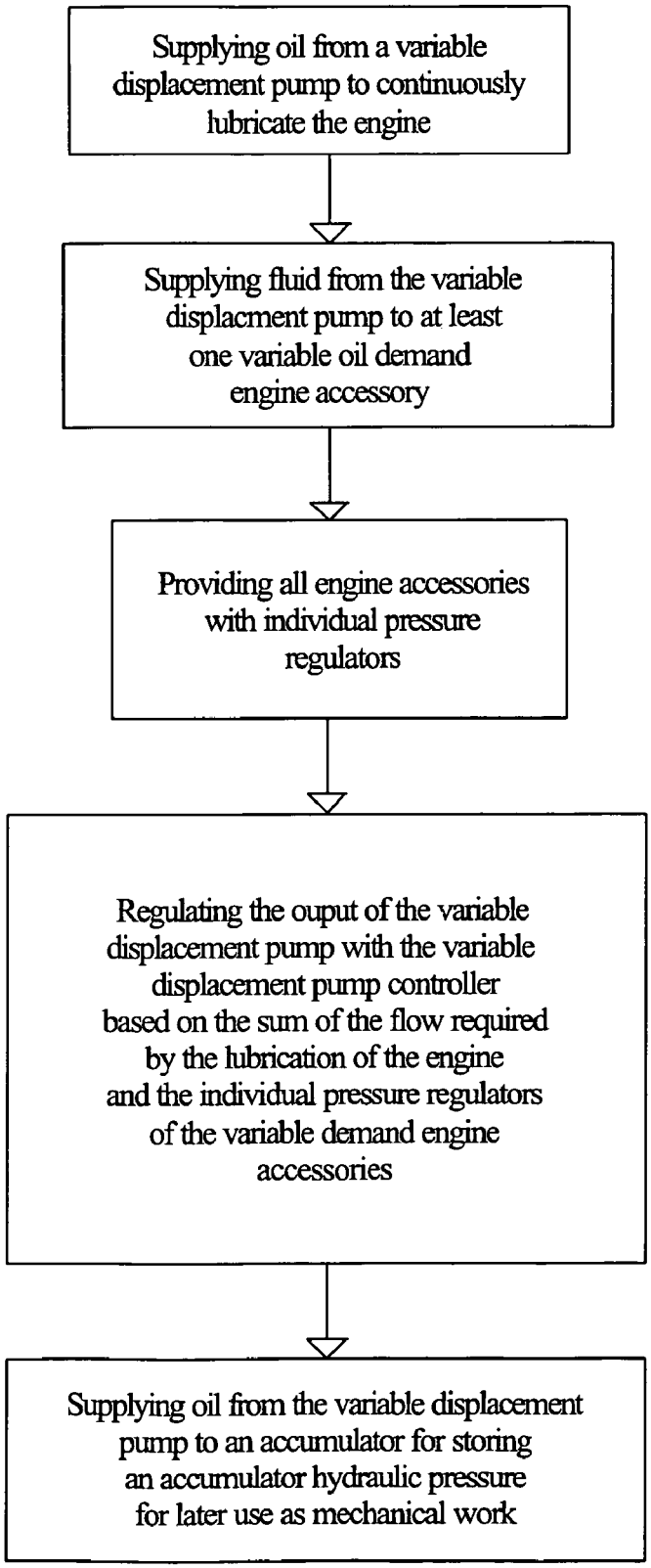
FIG. 6 shows a flow chart of the steps with an accumulator in an embodiment of the method of the present invention.

FIG. 6 shows the steps for providing hydraulic pressure for mechanical work from an engine lubricating system by first, supplying oil or fluid from the variable displacement pump 6 to lubricate the engine in another embodiment of the present invention. The variable displacement pump 6 provides fluid or oil to at least one of the variable oil demanding engine accessories 10, 14. Each of the engine accessories is also provided with individual pressure regulators 12, 16. The variable displacement pump 6 is regulated by the variable pump controller 20, which takes into account the temperature and speed sensors monitored by the ECU 28, based on the sum of flow required by the engine lubricating system, which is continuous, though variable, and the individual pressure regulators 12, 16 of the variable on-demand engine accessories 10, 14, regardless of the engine output. The variable displacement pump 6 provides fluid or oil to an accumulator for storing an accumulator hydraulic pressure for later use as mechanical work.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of providing hydraulic pressure for mechanical work from an engine lubricating system in an internal combustion engine, comprising the steps of:

a) supplying oil from a variable displacement pump to an engine lubrication gallery for lubricating the engine;

b) supplying oil from the variable displacement pump to at least one engine accessory having a variable oil demand, each accessory having a pressure regulator;

c) regulating an output of the variable displacement pump to a sum of a fluid flow required by the engine lubrication system and a fluid demand generated by the pressure regulators; and d) supplying oil from the variable displacement pump to an accumulator for storing an accumulator hydraulic pressure for later use as mechanical work.

2. The method of claim 1, wherein the at least one engine accessory is selected from the group consisting of:

a) a hydraulic motor driven cooling fan;

b) a power steering system;

c) a hydraulic motor driven air conditioning compressor;

d) a hydraulic motor driven engine coolant pump;

e) a hydraulic motor driven alternator;

f) a hydraulic motor driven supercharger;

g) an electrohydraulic valve actuation system; and h) a suspension actuator motor.

3. The method of claim 1, wherein the fluid flow for lubricating the engine is based on engine parameters.

4. The method of claim 1, further comprising the step of using the accumulator hydraulic pressure to power the at least one hydraulic accessory.

5. The method of claim 1, further comprising the step of using the accumulator hydraulic pressure via the variable displacement pump to add work to a crankshaft driven by the engine.

6. The method of claim 1, further comprising the step of supplying oil from a fixed displacement pump to the engine lubrication gallery for lubricating the engine, wherein the variable displacement pump supplies only enough oil to make up a difference between what the engine requires and what the fixed displacement pump supplies.

7. A hydraulic on-demand engine accessory drive system for an internal combustion engine comprising:

a variable displacement pump having a pump fluid communication input from a sump and a pump fluid communication output to a high-pressure manifold;

a variable displacement pump controller mounted to the variable displacement pump and in communication with an ECU;

an engine having an engine fluid communication input from the high-pressure manifold and an engine fluid communication output to the sump;

at least one engine accessory having a variable oil demand and a pressure regulator, wherein the pressure regulator is in fluid communication with and has a regulator input from the high-pressure manifold and a regulator output to the sump; and an accumulator having a fluid communication line to the high-pressure manifold for storing and supplying energy as an accumulator fluid pressure;

wherein the pump fluid communication output is regulated by the variable displacement pump controller based on a sum of flow required by the pressure regulator of the at least one engine accessory and the engine for lubrication, regardless of engine output.

8. The system of claim 7, wherein the high-pressure manifold powers the pressure regulator.

9. The system of claim 7, wherein the ECU monitors sensors on the engine.

10. The system of claim 9, wherein the sensors monitor temperature and speed of the engine.

11. The system of claim 7, wherein the at least one engine accessory is selected from the group consisting of:

a) a hydraulic motor driven cooling fan;

b) a power steering system;

c) a hydraulic motor driven air conditioning compressor;

d) a hydraulic motor driven engine coolant pump;

e) a hydraulic motor driven alternator;

f) a hydraulic motor driven supercharger g) an electrohydraulic valve actuation system; and h) a suspension actuator motor.

12. The system of claim 7, further comprising an oil cooler in the regulator output of the at least one engine accessory to the sump.

13. The system of claim 7, wherein the ECU controls whether the accumulator receives oil, maintains oil, or supplies oil.

14. The system of claim 7, wherein the accumulator hydraulic pressure powers the at least one hydraulic accessory.

15. The system of claim 7, wherein the accumulator hydraulic pressure adds work via the variable displacement pump to a crankshaft driven by the engine.

16. The system of claim 15, wherein the variable displacement pump replaces a conventional electric starter motor used for starting the engine.

17. The system of claim 7, further comprising a fixed displacement pump having a fixed pump fluid communication input from the sump and a fixed pump fluid communication output to the engine lubrication gallery for lubricating the engine.

18. The system of claim 17, wherein the variable displacement pump supplies only enough oil to make up a difference between what the engine requires and what the fixed displacement pump supplies.

19. A hydraulic on-demand engine accessory drive system for an internal combustion engine comprising:

a variable displacement pump having a pump fluid communication input from a sump and a pump fluid communication output to a high-pressure manifold;

a variable displacement pump controller mounted to the variable displacement pump and in communication with an ECU;

an engine having an engine fluid communication input from the high-pressure manifold and an engine fluid communication output to the sump; and at least one engine accessory having a variable oil demand and a pressure regulator, wherein the pressure regulator is in fluid communication with and has a regulator input from the high-pressure manifold and a regulator output to the sump; and wherein the pump fluid communication output is regulated by the variable displacement pump controller based on a sum of flow required by the pressure regulator of the at least one engine accessory and the engine for lubrication, regardless of engine output.

20. The system of claim 19, wherein the high-pressure manifold powers the pressure regulator.

21. The system of claim 19, wherein the ECU monitors sensors on the engine.

22. The system of claim 21, wherein the sensors monitor temperature and speed of the engine.

23. The system of claim 19, wherein the at least one engine accessory is selected from the group consisting of:

a) a hydraulic motor driven cooling fan;

b) a power steering system;

c) a hydraulic motor driven air conditioning compressor;

d) a hydraulic motor driven engine coolant pump;

e) a hydraulic motor driven alternator;

f) a hydraulic motor driven supercharger g) an electrohydraulic valve actuation system; and h) a suspension actuator motor.

24. The system of claim 19, further comprising an oil cooler in the regulator output of the at least one engine accessory to the sump.

25. The system of claim 19, further comprising a fixed displacement pump having a fixed pump fluid communication input from the sump and a fixed pump fluid communication output to the engine lubrication gallery for lubricating the engine.

26. The system of claim 25, wherein the variable displacement pump supplies only enough oil to make up a difference between what the engine requires and what the fixed displacement pump supplies.

* * * * *